US005605527A

United States Patent [19]

Gillieron

[11] Patent Number: 5,605,527

[45] Date of Patent: Feb. 25, 1997

[54] WASTE STRIPPING STATION IN A MACHINE THAT DIE-CUTS PLATE-LIKE WORKPIECES

[75] Inventor: Jean-Luc Gillieron, Lausanne, Switzerland

[73] Assignee: Bobst SA, Lausanne, Switzerland

[21] Appl. No.: 441,622

[22] Filed: May 15, 1995

[30] Foreign Application Priority Data

May 13, 1994 [CH] Switzerland ..... 01492/94

[51] Int. Cl.[6] ..... B31B 1/24

[52] U.S. Cl. ..... 493/342; 493/82; 493/373; 225/103

[58] Field of Search ..... 493/82, 83, 142, 493/143, 144, 340, 342, 373, 473, 363, 364, 366, 372, 370; 225/103, 104

[56] References Cited

U.S. PATENT DOCUMENTS

| | | | |
|---|---|---|---|
| 2,548,370 | 4/1951 | Hedstrom et al. | 493/373 |
| 3,060,776 | 10/1962 | Bobst et al. | 83/103 |
| 3,786,731 | 1/1974 | Bobst et al. | 493/373 |
| 4,452,595 | 6/1984 | Huff | 493/83 |
| 5,219,652 | 3/1994 | Vossen et al. | 493/83 X |
| 5,402,698 | 4/1995 | Morrison | 493/342 X |
| 5,474,219 | 12/1995 | Mano | 493/373 X |
| 5,529,565 | 6/1996 | Oetlinger | 493/342 X |

FOREIGN PATENT DOCUMENTS 2263080 10/1975 France .

*Primary Examiner*—Joseph J. Hail, III
*Assistant Examiner*—Eziamara Ojini
*Attorney, Agent, or Firm*—Hill, Steadman & Simpson

[57] ABSTRACT

A waste stripping station for a machine for die-cutting plate-like workpieces includes a perforated board which is positioned between an upper movable tool and a lower movable tool for supporting a plate-like workpiece carried into the station by grippers. Waste bits of the workpiece are pinched between pins or elements of the upper and lower stripping tools and are carried vertically downward through perforations in the board. In order to provide clearance for the grippers, the perforated board is mounted to pivot around an upstream edge in order that its downstream edge may be lifted from a position allowing passage of the grippers to a position slightly lifting the plate-like workpiece.

5 Claims, 2 Drawing Sheets x
a
--2--
101
100
1
5
6
9
10
11
12
13
14
15
16
18
19
20
22
24
26
26'
27
28
30
32
34
36
36'
37
38
40
41
42
43
44
45
46
47
50
51
52
53
54
55
56
57

WASTE STRIPPING STATION IN A MACHINE THAT DIE-CUTS PLATE-LIKE WORKPIECES

BACKGROUND OF THE INVENTION

The present invention is directed to a waste stripping station in a machine that die-cuts plate-like workpieces, such as sheets of paper or cardboard.

A machine which die-cuts one or more blanks in a sheet of paper, which blanks are then folded and glued to form folded box blanks, is disclosed in U.S. Pat. No. 3,060,776, whose disclosure is incorporated herein by reference thereto. Each of these box blanks, which are die-cut into a sheet, generally has six faces of a box, and some edges are completed with gluing or closing flaps or tongues. Preferably, the waste bits, i.e., the unused area of the sheet either between the tongues or between the blanks, are immediately stripped after the cutting action in order to leave, in the outlet pile, only finished blanks connected to each other by some nicks.

The die-cutting machine usually includes an infeed station in which the sheets are seized one-by-one from the top of a pile previously arranged and then carried onto a feeding table. On this feeding table, every sheet is aligned on front lays and side marks prior to being seized on a front edge of the sheet by a series of grippers which are mounted on a crossbar, whose two ends are attached to endless chains which transfer the bar and the sheet through the various stations of the device. Thus, a sheet will be transferred into a die-cutting station which includes a platen press provided with cutting blades and then to a waste stripping station, which is usually followed by a delivery station in which the sheet stripped of the waste is deposited into a stack of sheets of cut blanks. If desired, a printing station may be provided preceding the die-cutting station.

In the waste stripping station, the sheet is carried flat onto a horizontal board which is perforated according to the circumference of the waste bits to be stripped from the sheet. A horizontal upper stripping tool, which has a shape of a frame provided with crossbars supporting stripping pins or ejectors and/or pressers, is moved in a vertical direction. Beneath the perforated board is located a second horizontal stripping tool also having the shape of a frame supporting vertical telescopic pins arranged in correspondence with the upper ejectors or pins. The ends of the telescopic pins arrive in the aperture of the board slightly above the upper plane. Thus, when the upper tool is lowered onto a positioned die-cut sheet, the combination of the respective ejectors and telescopic pins pinch the waste bits and take them downward through the board and then they are dropped into a container. An example of this type of stripping station is disclosed in U.S. Pat. No. 3,786,731, whose disclosure is incorporated herein by reference thereto.

For rigidity purposes, the bars carrying the grippers are either full or made of profiled bars having a minimum thickness of 10 millimeters, and the thickness is usually in a range of 10 and 30 millimeters. Thus, if the grippers are high, i.e., they held the sheet at a level of the upper face of the bar, it is necessary to additionally shift the board and the lower tool, on the one hand, in a vertical alternating descending motion in order to let the gripper bar pass through and, on the other hand, in an ascending motion in order to support the sheet in its travelling direction.

However, an accurate and repetitive motion in the vertical translation of a board of a horizontal frame can be ensured only by acting simultaneously on its four corners. Thus, a current stripping station includes three sets of individual tools driven in translation, which fact necessitates a mechanism particularly heavy and of high inertia which will consume a lot of energy.

Moreover, the vertical motion of the tool causes important eddy currents of air within the station which have a pernicious influence on the accurate positioning of the sheet which is fragile because of the die-cutting operation.

SUMMARY OF THE INVENTION.

The object of the present invention is to provide a waste stripping station within a machine that die-cuts plate-like workpieces, which includes so-called high gripping bars with a disposition of the constitutive parts that enables an improvement of their cinematic, particularly owing to a reduction in the number of parts for motion control.

These goals are achieved in a waste stripping station which includes a perforated board which is movable by a first control device in order to carry a plate-like workpiece from which the bits are pinched and taken downward by upper and lower stripping tools having the shape of telescopic pins belonging, respectively, to an upper stripping tool and lower stripping tool, which tools are vertically movable under the action of a second and a third control device, the perforated board being raised only on its downstream edge in order to pivot around its upstream edge and lift the workpiece.

For an accurate understanding of the description, the words "upstream" and "downstream" have to be considered with regard to the sheet travelling direction. In other words, the upstream part is that closest to the inlet of the station and the downstream part being the closest to the outlet station.

In an advantageous embodiment, the raising of the downstream edge of the board is achieved to a height which is equal to a little more than the thickness of the gripping bar. For example, according to an angular rotation of a range between 1 and 6 degrees around its upstream edge, and preferably is limited in a range of between 2 and 4 degrees.

After multiple workshop confirmation tests, it has been noticed that, during the standstill of a sheet and the raising of the downstream edge of the board, the free upstream edge of the sheet lands quickly and with no difficulty on the upstream edge, which remains almost still immobile on the corresponding perforated board. This descent can be effected all the better because, due to the motion of the board being reduced to a mere minimum, the eddy currents are reduced as well. The sheet being then perfectly carried as before, although slightly askew, the stripping tool can evacuate or remove the waste bits without hindrance. With this solution, the device for controlling the motion of the board has been simplified and a savings of about 20% on the number of pieces or parts making up the device for controlling the motion of the board has been achieved.

For a better coordination of the motion, the stripping tools can themselves be mounted to travel in an askew path which extends at a slight angle to a vertical so that the tool moves at right angles to the plane of the board.

When the perforated board is inserted in a lateral translation on the upstream and downstream supporting strips, the raising device can act directly on the sole downstream strip which may be connected, if desired, to a pair of horizontal guiding arms which pivot around an upstream end.

The invention will be better understood from the following description of the preferred embodiments, the drawings and claims.

DESCRIPTION OF THE PREFERRED EMBODIMENTS

Figure 1:
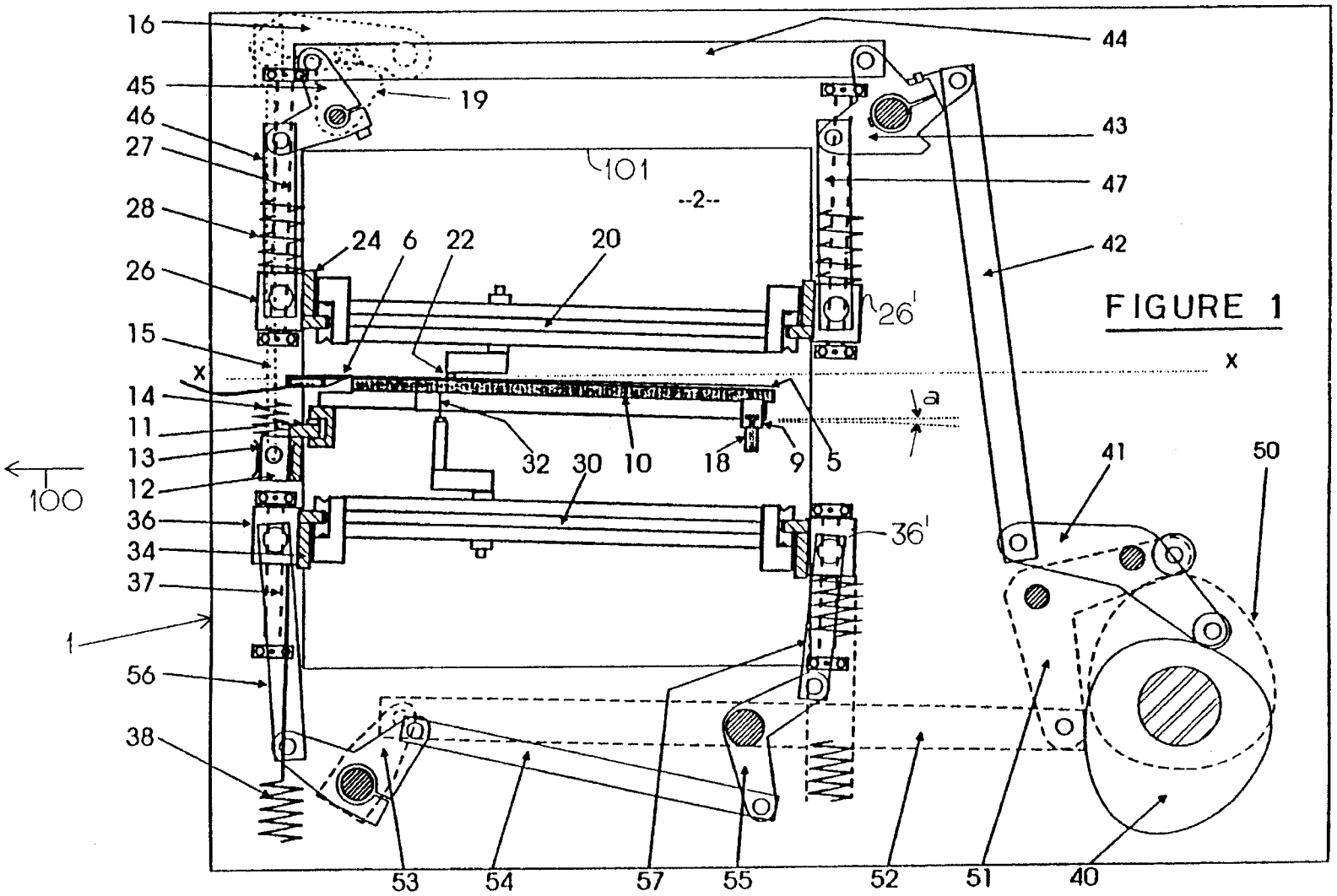
FIG. 1 is a schematic lengthwise cross sectional view with portions in elevation of a waste stripping station according to the present invention.
Figure 2:
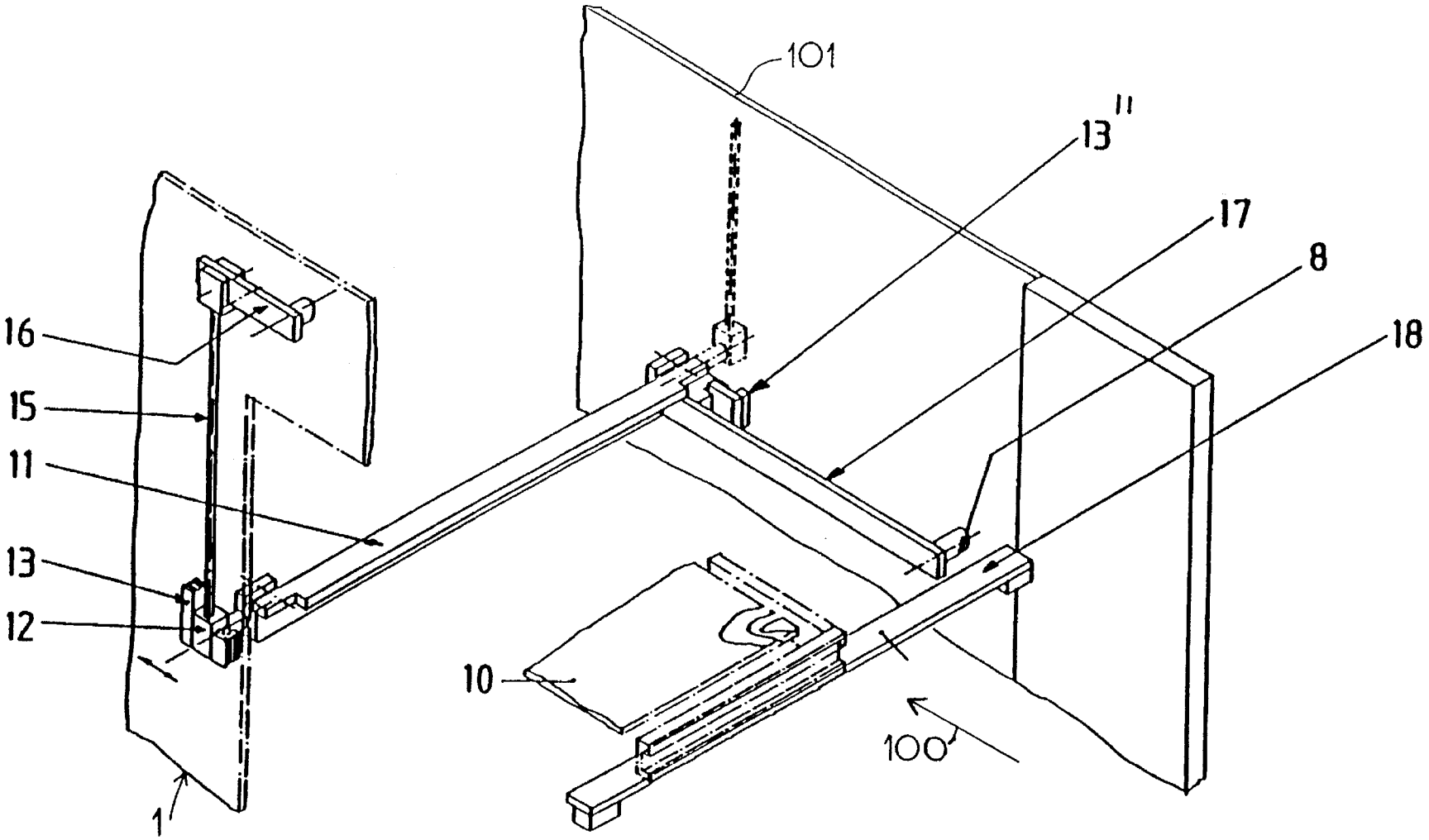
FIG. 2 is a perspective view with portions removed for purposes of illustration of a device for controlling the movement of a perforated board.

The principles of the present invention are particularly useful when incorporated in a waste stripping station, generally indicated at 1 in FIGS. 1 and 2. In the stripping station 1, a plate-like workpiece 5, such as a sheet of paper or cardboard which is carried onto an upper face of a perforated board 10 by grippers 6 fitted on a bar 6*a* which is driven by two trains of lateral continuous chains, which are not represented. When the sheet 5 is at a standstill on the board 10, corresponding pairs of fixed upper pins 22 and lower telescopic pins 32 belonging respectively to an upper stripping tool 20 and lower stripping tool 30 seize a waste bit area from above and from beneath in order to carry the waste bit area with a downward translational motion away from the sheet 5 and to let it drop in a subsequent container, which is not represented. Once the sheet 5 has the waste bits removed, the sheets are again seized by the grippers 6 and carried in a direction of arrow 100 toward an outlet station located on the left-hand side of FIG. 1.

As represented in FIG. 1, the waste stripping station 1 has a frame which includes two lateral windows 2 in sidewalls 101 which allow the access to the tools to be changed when changing from one run to another with different sizes. The tools 20 and 30 have both the shape of frames made up of aluminum profiled pieces, which are shown in elevation in FIG. 1.

In the frame of each tool 20 and 30, a plurality of lengthwise beams and crossbars are arranged in order to fit in corresponding upper ejectors 22 having the shape of fixed pins, as well as lower ejectors 32 with the shape of telescopic pins. The upper tool 20 can also carry a plurality of pressers in order to press the sheet 5 on the board 10. The frames of the tools 20 and 30 have, at least on their upstream and downstream sides, horizontal grooves which allow for sliding the frames in a lateral translational motion through the window 2 on slides on an upper cradle 24 and slides of a lower cradle 34 of the stripping station 1.

The board 10 is perforated according to the areas of waste bits which are specific to a given size. This board is inserted in a frame which also includes horizontal upstream and downstream grooves, which allows to engage the board in an upstream supporting strip 18 and a downstream supporting strip 11.

As represented in FIG. 1, the transporting grippers 6 have the sheet 5 seized on their upper surface. To this end, it is necessary to regularly lower the board 10 in order to allow for passage of the gripper bar which carries the next sheet. Then the board 10 must be raised so that the board correctly supports the sheet during the waste stripping action.

More specifically, according to the present invention, only the downstream support strip 11 is raised in order to bring the upper downstream edge of the board 10 at the level arriving at plane X—X of the sheet 5. In the alternative represented in FIG. 1, the upstream side of the frame of the board is inserted on the upper side of the fixed upstream support strip 18 with the connection, for example, of a dovetail-type connection making then the rotation of a rotational pivot 9 of the raising motion of the board which is caused by the raising of the downstream support strip 11.

As an alternative solution, as represented in FIG. 2, the fixed support 18 is conventionally horizontal and the downstream support strip 11 is connected between two lateral arms 17 (FIG. 2) mounted on their upstream ends to pivots 8 in order to enable them to be raised according to a rotation around these separate pivots. As better visualized in FIG. 1, the raising of the strip 11 to equal the thickness of the grippers implies a rotation of the board 10 around the pivots 8 and 9 with an angle a included between 1 and 6 degrees, and preferably in a range of 2 to 4 degrees. This small rotation angle $\alpha$ allows specifically to keep the way of fixing the frame of the perforated board 10 to the support strips by simply engaging the edge of the board in the corresponding groove on the side of the frame.

As best illustrated in FIG. 2, the supporting strip 11 is guided for movement perpendicular to the sheet travelling direction 100 by means of vertical guides 13 and the strip 11 is guided relative to a wall 101 of the frame of the station 1 by guides 13" which are parallel and offset with regard to the wall 101.

More specifically, according to the invention and as illustrated in FIG. 1, the stripping tools 20 and 30 are arranged to extend parallel to the perforated board 10 when the board is in the raised position. To accomplish this, the blocks 26 and 26' for holding the cradle and support strips of the cradle 24 slide along tubes or guide ribs 27, which are mounted to extend at an angle identical to angle $\alpha$ to a vertical line. In a symmetrical way, the blocks 36 and 36' connected to the support strips of the lower cradle 34 of the lower stripping tool 30 also slide along tubes or guide ribs 37, which are mounted to be parallel to the guides 27 and, thus, extend at an angle to a vertical, which angle is the same as the angle $\alpha$.

As may be gathered from this Figure, this slanted mounting of the tools 20 and 30 in no way hinders the device for controlling the vertical motion. In fact, the control device for the upper stripping tool 20 includes, first of all, a cam 40 connected to a principal motor shaft of the die-cutting machine. The position of the cam is read by a roller belonging to a first branch of a scanning lever 41, whose other branch is connected through rotational movement to a control bar or linkage 42. The other end of the bar 42 is connected pivotably to a treble lever 43, whose second branch is connected pivotably to a synchronization bar or linkage 44 orientated along the lateral wall of the station 1 and whose third branch is pivotably connected to a third upstream pull link 47 which acts on an upstream block 26' of the tool 20. The other end of the bar 44 is pivotably connected to a single lever 45 whose other branch is connected to a pull link 46 which acts on a downstream block 26 for the tool 20. Thus, the two blocks 26 and 26' on one side of the tool 20 are actuated and the two blocks 26 and 26' on the opposite side of the tool 20 are actuated in a similar manner by links attached to levers mounted on the shaft supporting levers 43 and 45.

As may easily be understood from FIG. 1, the raising of the scanning lever 41 by the cam 40 pulls downward on the link 42, which brings about a simultaneous raising of the pull links 47 and 46 to simultaneously raise the blocks 26 and 26' of the cradle 24 with the upper tool 20. This action is executed against the compression of springs, such as 28. This raise in the tool is achieved during the transfer of the new sheet 5.

In a symmetrical manner, the device for controlling the motion of the lower stripping tool 30 includes, first of all, a cam 50, whose position is scanned by a scanning lever 51 which acts on a control bar 52 connected to a treble lever 53. A second branch of the treble lever is connected to a downstream pusher 56 connected to the downstream block 36, wherein the third branch is connected by a synchronizing bar linkage 54 to a second lever 55, which acts directly on an upstream pusher 57 attached to the upstream block 36'. The blocks 36 and 36' on the other side are connected to links and levers that move with levers 53 and 55.

The raising of the scanning lever 51 by the cam 50 will cause the control bar 52 to pull toward the right-hand side, which action causes a coordinated raising of the pushers 56, 57, which will raise simultaneously the blocks 36 and 36' and the support strip of the lower cradle 34 of the tool 30. This action is executed against the tension of springs, such as 38. This operation will occur during the stripping of the waste bits once the sheet 5 has been laid on the board 10.

All the connections of the elements which make up the above-described device for the motion control are rotary connections, and there is no interference with the fact that the tools 20 and 30 move in a translational movement slightly skewed to the vertical. Advantageously, and as better illustrated in the upper left-hand part of FIG. 1 and in FIG. 2, the control for controlling the motion of the downstream support strip 11 of the board 10 includes a rod 15 rotatably connected on one end to a sliding block 12 that supports the strip 11 and the other end of the rod 15 is connected to a lever 16 which is mounted at its upstream end for pivoting. This lever is raised by a cam 19 (FIG. 1) during the counter-clockwise rotation of the lever 45 to which the cam belongs. This rigid connection between the lever 45 and the cam 19 more or less is wedged in advance or behindhand ensures the perfect synchronization between the previous raise of the support strip 11 and, hence, the rotation of the board 10, a possible reaction time for the landing of the upstream edge of the sheet 5 on the board and the lowering into position of the tool 20 simultaneously with the setting into the raised position of the tool 30. The continuation of the descent of the tool 20 onto the telescopic pins 32 is accentuated at the level of the cam 19 by a rigorous circular upstream part.

As may have been gathered from the reading of this description, the waste stripping station 1, according to the invention, can operate in a reliable and efficient way, although the upstream part of the perforated board 10 is not set into motion which enables a substantial savings of the number of pieces or elements making up the device for motion control.

Although various minor modifications may be suggested by those versed in the art, it should be understood that I wish to embody within the scope of the patent granted hereon all such modifications as reasonably and properly come within the scope of my contribution to the art.

I claim:

1. A waste stripping station in a machine that die-cuts plate-like workpieces, said stripping station including an upper stripping tool having pins, a lower stripping tool having telescopic pins, means for mounting said upper and lower stripping tools to reciprocate in a vertical direction, a perforated board being positioned between said upper and lower stripping tools and mounted for rotation around an upstream edge of the board, means for raising the downstream edge of the perforated board to lift a plate-like workpiece having waste bits seized by the pins of the upper and lower stripping tools.

2. A waste stripping station according to claim 1, wherein the means for raising the downstream edge of the board raises the downstream edge in a range of 1 to 6 degrees around the upstream edge.

3. A waste stripping station according to claim 2, wherein the means for raising the downstream edge raises the downstream edge in a range of 2 to 4 degrees.

4. A waste stripping station according to claim 1, wherein the means for mounting the upper and lower stripping tools mounts these tools for movement along a line extending at an angle to the vertical line.

5. A waste stripping station according to claim 1, wherein said perforated board is mounted by being inserted on lateral translation on upstream and downstream supporting strips, the means for rotating the perforated board around the upstream edge including a downstream support strip being mounted on guiding arms pivotable around a horizontal axis on their upstream ends.

* * * * *